United States Patent [19]

Yokoyama

[11] Patent Number: 5,006,893

[45] Date of Patent: Apr. 9, 1991

[54] IMAGE FORMING APPARATUS WITH IMPROVED TONER REPLENISHMENT

[75] Inventor: Tomoaki Yokoyama, Osaka, Japan

[73] Assignee: Minolta Camera Kabushiki Kaisha, Osaka, Japan

[21] Appl. No.: 285,722

[22] Filed: Dec. 16, 1988

[30] Foreign Application Priority Data

Dec. 18, 1987 [JP] Japan ..... 62-322246
Dec. 18, 1987 [JP] Japan ..... 62-322247

[51] Int. Cl.[5] ..... G03G 15/00
[52] U.S. Cl. ..... 355/208; 355/246
[58] Field of Search ..... 355/208, 246, 243; 118/665, 688-691; 222/DIG. 1

[56] References Cited

U.S. PATENT DOCUMENTS 4,416,535 11/1983 Tottori ..... 355/246
4,833,506 5/1989 Kurn et al. ..... 355/246 X

FOREIGN PATENT DOCUMENTS 51-144236 12/1976 Japan .
59-40669 5/1984 Japan ..... 355/246
60-76775 5/1985 Japan ..... 355/246
60-247271 12/1985 Japan ..... 355/246
60-256168 12/1985 Japan ..... 355/246
61-55673 3/1986 Japan ..... 355/208
62-3269 1/1987 Japan ..... 355/246

*Primary Examiner*—Joan H. Pendegrass
*Attorney, Agent, or Firm*—Willian, Brinks, Olds, Hofer, Gilson & Lione

[57] ABSTRACT

When an image forming process is a prescribed process consuming toner rapidly, the toner is supplied at any time besides the normal toner supply timing. Therefore, the toner is supplied frequently, the period of normal toner supply timing in which a large amount of toner is supplied becomes longer, and the toner is well mixed with the developer. When the image forming process is a prescribed process consuming toner rapidly, the period of determining toner concentration is made shorter. Consequently, the number of toner replenishment is increased, and the fluctuation of the toner concentration in the developer becomes small.

22 Claims, 12 Drawing Sheets

A: PRIOR ART; TONER SUPPLY UNDER TONER CONCENTRATION CONTROL ONLY

B: EMBODIMENT OF THE PRESENT INVENTION; CONSTANT TONER SUPPLY OF 20mg AT A TIME ADDED TO A

IMAGE FORMING APPARATUS WITH IMPROVED TONER REPLENISHMENT

BACKGROUND OF THE INVENTION

1. Field of the Invention

The present invention relates to image forming apparatuses employing electrophotography process (for example, copying machines, laser printers). More specifically, the present invention relates to an improvement of toner replenishment for a developing apparatus employing two-component developer containing toner and carriers.

2. Description of the Background Art

In an image forming apparatus employing electrophotography process, toner concentration in a developer contained in a developing apparatus for developing latent electrostatic images must be kept in a constant appropriate range. When the toner concentration in the developer becomes too low, the density of the toner image will be lowered. Therefore, toner replenishing systems have been proposed in which a prescribed amount of toner is newly supplied when it is detected that the toner concentration in the developer or the toner image density becomes lower than a prescribed level, so as to maintain the toner concentration in a proper range.

More specifically, a magnetic sensor for detecting magnetic permeability of the developer is provided in the developing apparatus to detect a change in the magnetic permeability of the developer incidental to the change of the toner concentration. Based on the result of detection, when the toner concentration is lower than a reference value, a prescribed amount of toner is newly supplied. Alternatively, a latent electrostatic image of a reference pattern is formed on a photoreceptor, and the density of the toner image formed by developing the latent electrostatic image is detected by a photo sensor. When the detected density becomes lower than a predetermined value, a prescribed amount of toner is newly supplied.

Generally, the timing of detection of the toner concentration and of the replenishment is constant regardless of the types of originals and the manner of copying.

In the above described toner replenishment, a prescribed amount of toner is supplied periodically for the following reason. Namely, the toner concentration in the developing apparatus is not uniformly increased in real time in direct response to the new supply of the prescribed amount of toner.

However, if the timing of the toner replenishment is determined such that the toner is newly supplied after the toner is stirred for a prescribed time period, the toner supply will be late to cope with the rapid consumption of toner.

Namely, when an original having large image area must be copied for many times continuously, the toner consumption is large and a small supply of toner cannot cope with the decrease of the toner concentration.

To solve the above problem, the amount of toner to be newly supplied may be increased to a large amount.

However, when the large amount of toner is consumed in a short period of time and the toner replenishment is repeated for many times, the newly supplied toner cannot be uniformly dispersed. Consequently, the fluctuation of the toner concentration becomes large and aside therefrom, some part of the toner is not fully electrified because of insufficient frictional electrification with carriers. This may possibly result in fog on the copy. The toner which is not fully electrified may splash in the apparatus causing contamination.

SUMMARY OF THE INVENTION

An object of the present invention is to realize good toner replenishment in an image forming apparatus.

Another object of the present invention is to realize toner replenishment corresponding to various image forming conditions in an image forming apparatus.

Another object of the present invention is to realize, in an image forming apparatus toner replenishment in which toner will be well electrified even in an image forming process in which the toner is rapidly consumed.

A still further object of the present invention is to realize in an image forming apparatus toner replenishment in which the fluctuation of toner consumption is small even in an image forming process in which the toner is rapidly consumed.

In order to attain the above described objects, the image forming apparatus in accordance with the present invention comprises: a photoreceptor; latent electrostatic image forming means; developing means; concentration detecting means; supplying means; first control means; setting means; and second control means. A latent electrostatic image is formed on the photoreceptor. The latent electrostatic image forming means forms latent electrostatic images on the photoreceptor. The developing means develops latent electrostatic images on the photoreceptor by using a developer containing toner. The concentration detecting means detects toner concentration of the developer. The supplying means supplies toner to the developing means. The first control means activates the supplying means when the toner concentration detected by the concentration detecting means is lower than a prescribed concentration. The setting means sets image forming conditions. The second control means activates the supplying means when the image forming conditions set by the setting means coincide with prescribed conditions.

In order to attain the above described objects, the image forming apparatus in accordance with the present invention comprises, in another aspect, a photoreceptor; latent electrostatic image forming means; developing means; concentration detecting means; determining means; supplying means; setting means; and control means. Latent electrostatic images are formed on the photoreceptor. The latent electrostatic image forming means forms latent electrostatic images on the photoreceptor. The developing means develops latent electrostatic images on the photoreceptor by using a developer containing toner. The concentration detecting means detects toner concentration of the developer. The determining means determines at a prescribed period whether the detected toner concentration is lower than a prescribed concentration or not. The supplying means supplies toner to the developing means in response to a determining output indicating that the toner concentration is lower than the prescribed concentration from the determining means. The setting means sets image forming conditions. The control means changes the prescribed period of the determining means when the image forming conditions set by the setting means coincide with prescribed conditions.

In the image forming apparatus structured as described above, the supplying means is activated corresponding to the change of the image forming conditions, whereby appropriate toner replenishment can be carried out.

In another aspect, in the image forming apparatus structured as described above, the period of detecting toner concentration is changed corresponding to the change of image forming conditions, whereby appropriate toner replenishment can be carried out.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, one embodiment of the present invention will be described with reference to the figures, in which the image forming apparatus as an example is a copying machine.

Figure 1:
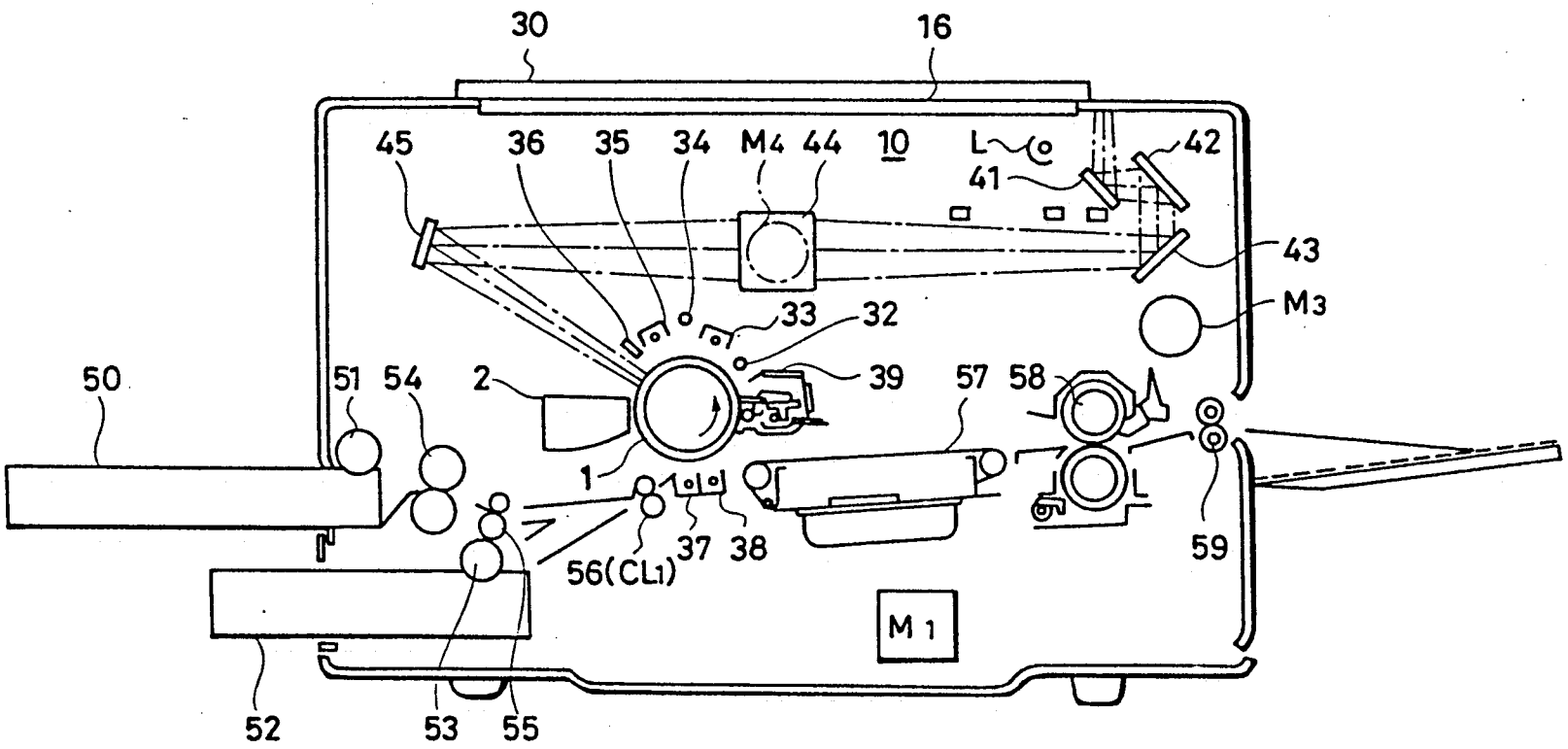
FIG. 1 is a schematic cross sectional view showing a copying machine in accordance with one embodiment of the present invention.

FIG. 1 shows a schematic structure of a copying machine in accordance with the present embodiment. A photoreceptor drum 1 is arranged approximately at the center of a body of the copying machine, the photoreceptor drum being rotatable in the counter clockwise direction by a main motor M1. Arranged around the photoreceptor drum 1 are a main eraser lamp 32, a sub corona charger 33, a sub eraser lamp 34, a main corona charger 35, an eraser 36 for erasing portions other than images, a developing apparatus 2, a transfer charger 37, a charger 38 for separating copy papers, and a blade type cleaning apparatus 39. The photoreceptor drum 1 has a photosensitive layer provide on the surface thereof. The photosensitive layer passes through the said eraser lamps 32 and 34 and the corona chargers 33 and 35 to be uniformly charged, and it receives image exposure from an optical system 10. The optical system 10 is provided below an original glass support 16 for scanning the original, and the system comprises a light source L, movable mirrors 41, 42 and 43, a lens 44 and a mirror 45. The said light source L and the movable mirrors 41, 42 and 43 are driven by a DC motor M3 such that the said light source L and the movable mirror 41 move to the left at a speed of V/m, where V represents a peripheral speed of the photoreceptor drum 1 (which is constant regardless of equal scale magnification/variable scale magnification, 150 mm/sec in this embodiment) and m represents copying magnification, and that the movable mirrors 42 and 43 move to the left at the speed of V/2m. By the scanning of the original image by the optical system, the said photoreceptor drum 1 receives image exposure, and latent electrostatic images are formed thereon. Toner is applied to the said latent electrostatic images by means of the said developing apparatus 2.

The said eraser 36 for erasing portions other than images is constituted by an arrangement of a number of LED elements in an axial direction of the photoreceptor drum 1. The eraser 36 removes charges on regions on the photoreceptor drum 1 other than effective image forming regions by photo illumination, thereby preventing unnecessary consumption of toner.

Paper feeding portions 50 and 52 having paper feeding rollers 51 and 53, respectively, are provided on the left side of the body of the copying machine. A copy paper conveying path is constituted by roller pairs 54 and 55, a timing roller pair 56, a conveyor belt 57, a fixing apparatus 58 and a discharging roller pair 59.

The said timing roller pair 56 feeds a copy paper which is fed from the paper feeding portion with the front end arranged with the toner image forming region formed on the photoreceptor drum 1 to the photoreceptor drum 1. The toner image is transferred to the fed copy paper by the transfer charger 37, and the copy paper is separated from the surface of the photoreceptor drum 1 by the separating charger 38. Thereafter, the copy paper is fed on the conveyor belt 57, the toner is heat fixed in the fixing apparatus 58, and the paper is discharged out of the copying machine by means of the discharging roller pair 59.

Figure 2:
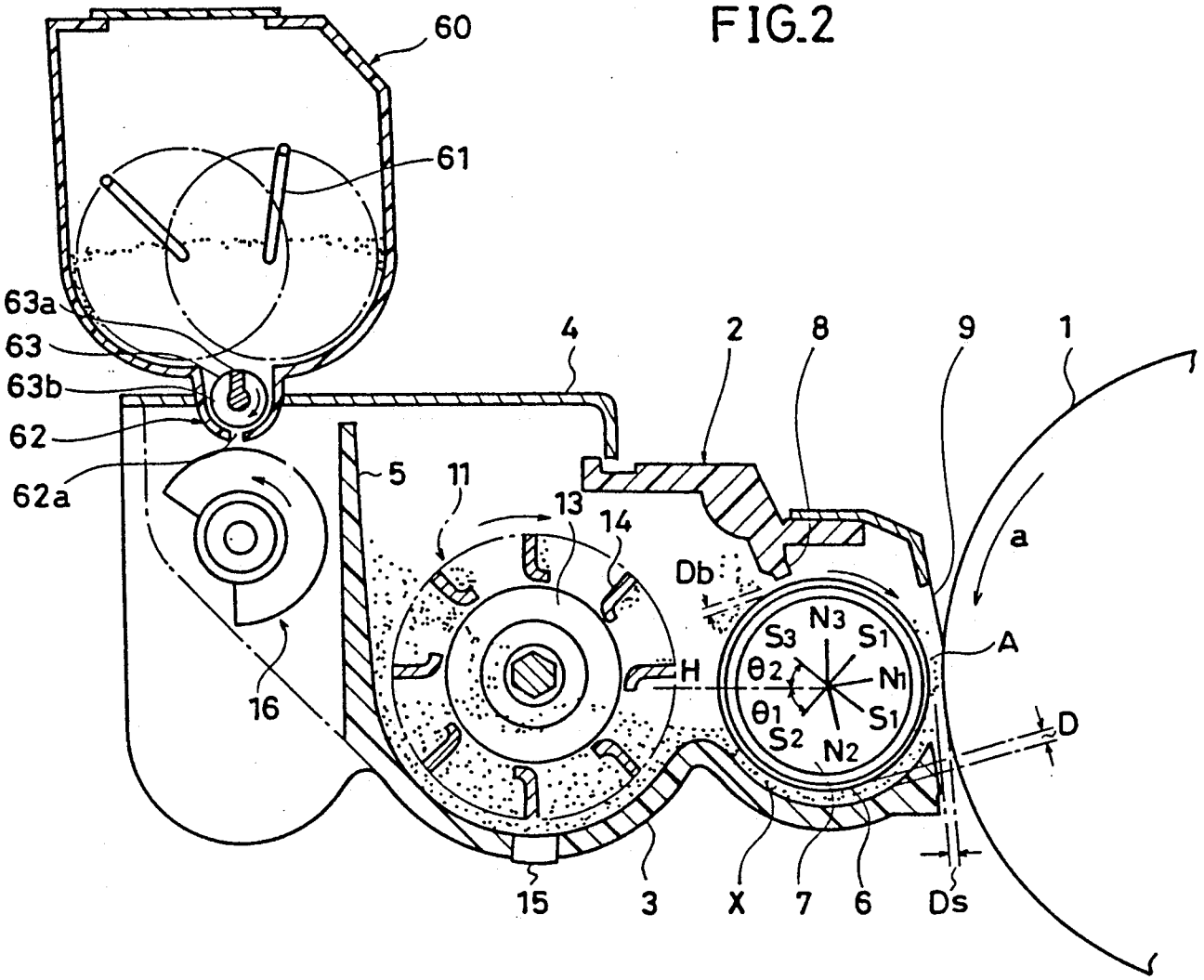
FIG. 2 is a schematic cross sectional view showing a developing apparatus and toner supplying means in accordance with one embodiment of the present invention.

FIG. 2 is a schematic partial sectional view showing the said developing device and the toner supply means.

As shown in FIG. 2, the developing apparatus 2 mainly comprises a first screw vane 16, a bucket roller 11 and a developing sleeve 6 arranged in this order from the side far from the photoreceptor drum 1, which are held in a space formed by a casing 3 and a cover 4. A toner supply tank 60, which is the toner supply means, is arranged at a position above one end of the first screw 16 (whose axis is extending vertical to the sheet).

Figure 3:
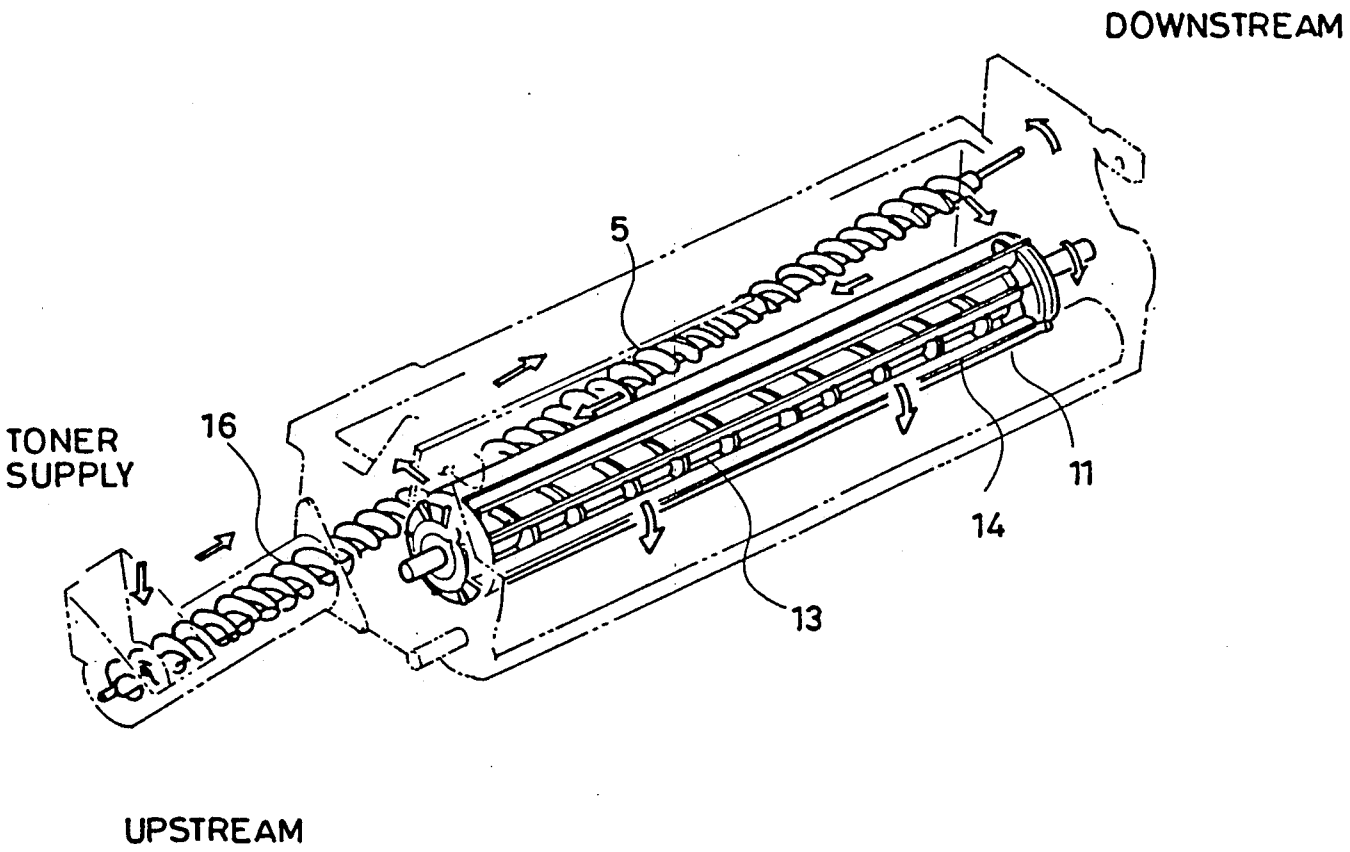
FIG. 3 is a perspective view of a first screw vane and a bucket roller in accordance with one embodiment of the present invention.

FIG. 3 is a perspective view showing the said first screw vane 16 and the bucket roller 11.

As shown in FIG. 3, the first screw vane 16 is spiral, and it feeds toner supplied from a toner supply tank 60 (not shown) from the upstream side, which is on the left in the figure, to the downstream side which is on the right side of the figure, while mixing and stirring toner with the developer by the rotation of itself in the counter clockwise direction. In the present embodiment, the developer is a two-component developer comprising toner and magnetic carriers.

The bucket roller 11 has a second screw vane 13 at the axis portion, and L shaped vanes 14 arranged radially at the outer peripheral portion, as shown in FIG. 2. The second screw vane 13 and the L shaped vanes 14 are fixed on both ends in the axial direction, and integrally rotate in the clockwise direction. The first screw vane 16, the bucket roller 11 and the developing sleeve 6 are driven and rotated by the main motor M1.

The said L shaped vane 14 scoops the toner at the L shaped portion and conveys the toner to the upper portion of the bucket roller 11 by rotation, thereby enabling deposition of the developer between magnetic poles ($S_1$, $N_3$) on the bucket roller 11. The said bucket roller conveys the developer at the upper portion and stirs the developer at the lower portion. The developer is fed from the right side to the left side in the figure by the rotation of the second screw vane 13. A magnetic sensor 15 for detecting magnetic permeability of the developer is arranged in the casing 3 below the bucket roller 11 in order to detect the toner concentration in the magnetic carriers.

A partition 5 is provided between the said first screw vane 13 and the bucket roller 11. Openings are formed on the partition 5 at positions corresponding to opposite ends of the bucket roller 11 in the axial direction. The circulating conveyor path of the developer is formed by the first screw vane 16 and the second screw vane of the bucket roller 11 through the openings at both ends of the partition 5.

More specifically, the toner is supplied from the toner supply tank 60 to one end of the conveying path including the first screw vane 16, and the supplied toner is mixed with carriers contained in the casing 3 and conveyed to the downstream side by the rotation of the first screw vane. Meanwhile, the developer comprising the toner and carriers is fed from the downstream side to the upstream side by the rotation of the second screw vane 13 to be fed to the first screw vane 16 through the opening, on the left side of the figure, of the partition 5.

The developer fed from the bucket roller 11 to the first screw vane 16 has low toner concentration. The reason for this is that the toner is supplied on the photoreceptor drum 1 to be gradually consumed while the developer is fed to the left side as viewed in the axial direction in the bucket roller 11.

Therefore, the developer with lower toner concentration is mixed and stirred with the newly supplied toner by the first screw vane 16 to be fed to the inner most side of the first screw vane 16.

Then, the developer fed to the inner most side of the first screw vane 16 is fed to the inner most side as viewed of the bucket roller 11 through the opening on the right side of the partition 5. Thus, a circulation and stirring path of the developer is formed as described above.

The developing sleeve 6 contains a magnetic roller 7 with magnetic poles provided on the outer peripheral portion thereof, and the sleeve holds the developer on the outer peripheral surface by the magnetic force of the magnetic roller 7. The developing sleeve 6 feeds the developer fed from the bucket roller 11 to the developing region (A) opposing to the photoreceptor drum 1 to be in contact with the latent electrostatic image formed on the photoreceptor drum 1 for development. The developing sleeve 6 is a cylinder formed of non-magnetic conductive material (for example, aluminum). The surface thereof is made rough by sandblasting. The sleeve is spaced apart from and opposed to the photoreceptor drum 1 the space being a development gap: Ds=0.6 mm, and the sleeve can be rotary driven at 143.64 rpm in the clockwise direction.

The lower portion of the developing sleeve 6 is spaced apart from the casing 3 by a gap: D=1.0 mm.

The outer diameter of the magnetic roller 7 is 24.5 mm. Magnetic poles ($N_1$ to $N_3$) and ($S_1$ to $S_4$) are alternately provided on the outer peripheral portion, and the magnetic poles ($S_2$) and ($S_3$) of the same polarity are provided adjacent to each other on the upper and lower sides, respectively, of a portion which is nearest to the said bucket roller 11 and on the opposite side of the developing region (A). The magnetic force of the magnetic pole ($N_1$) is 900 G and the magnetic forces of other magnetic poles ($N_2$, $N_3$, $S_1$ to $S_4$) are 500 to 600 G.

Consequently, the magnetic force becomes zero between the magnetic poles ($S_2$) and ($S_3$), so that the developer cannot be held on the developing sleeve 6. Therefore, the developer on the developing sleeve 6 is replaced with the developer on the lower portion of the bucket roller 11.

A deposition regulating member 8 is formed on the upper portion of the casing 3. The deposition regulating member 8 is opposed to the developing sleeve 6 at the intermediate portion between the magnetic poles ($S_3$ and $N_3$) spaced apart by a regulating gap Db=0.5 mm. It makes constant the height of deposition of the developer fed by the developing sleeve 6, so as to regulate the fed amount of the developer.

A splash preventing plate 9 formed of a polyethylene film (with a thickness of 0.1 mm) is provided above a portion of the casing 3 opposing to the photoreceptor drum 1. The plate 9 prevents powder toner generated around the developing sleeve 6 from splashing to the upper side.

The toner supply tank 60 is to supply toner to the developing apparatus 2, and a stirring bar 61 for preventing bridging phenomenon, blocking and the like of the toner is rotatively arranged at a position slightly lower than the central portion. A supplying portion 62 for dropping toner contained in the toner supply tank 60 is provided at the bottom portion. A rotatable toner supply roller 63 with two spiral vanes **63*b* provided on the support axis is provided in the supply portion 62. The direction of the spirals of the vanes 63*b* are opposite to each other, so that the toner is fed to the central portion. A toner supply opening 62*a* is formed below the central portion. The toner supplying roller 63 and the said stirring bar 61 are rotary driven in synchronization with a toner supplying motor 201 (see FIG. 5), and the toner whose amount corresponds to the amount of rotation is dropped from the toner supplying opening 62*a* to be applied on the first screw vane 16**.

Figure 4:
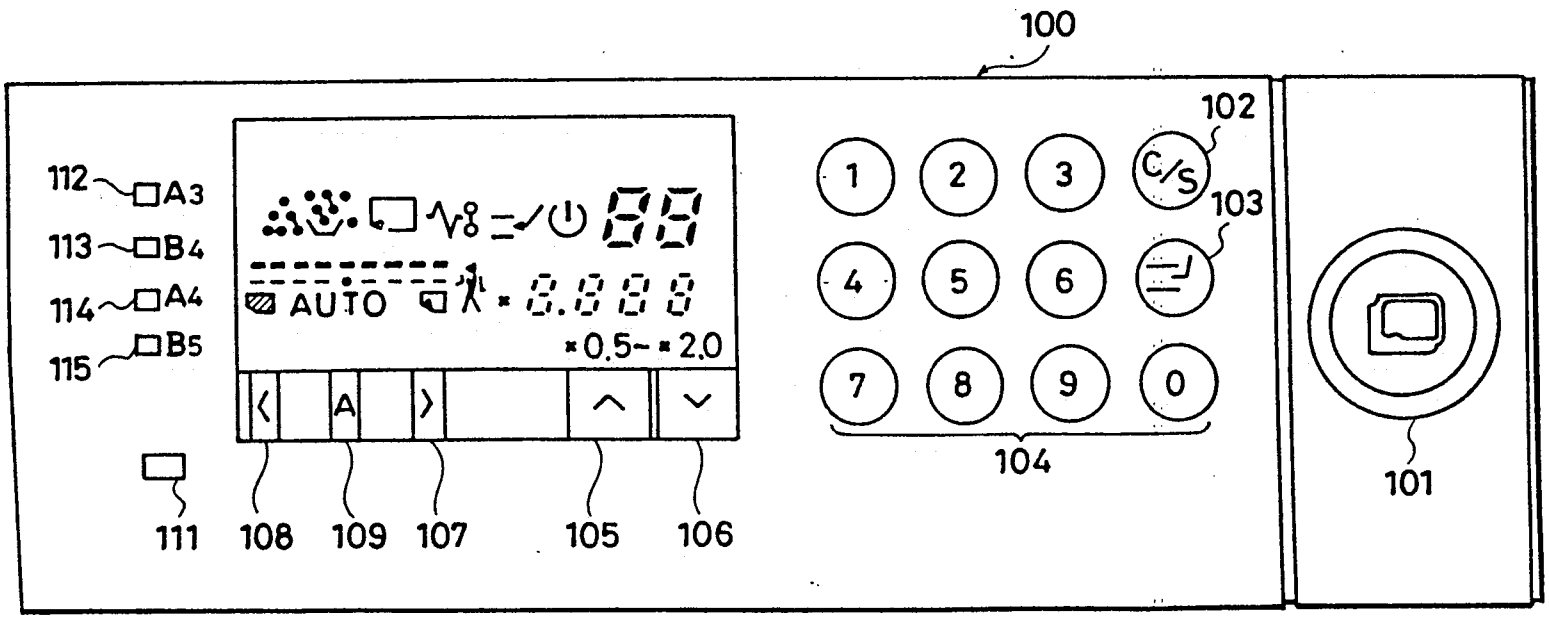
FIG. 4 is a plan view showing an operation panel of the copying machine shown in FIG. 1.

An operating panel 100 shown in FIG. 4 is provided on the upper portion of the said copying machine On the operation panel 100 are: a print start switch 101 for instructing start of copying operation; a clear.stop switch (c/s key) 102 for stopping the copying operation directly after the start of copying or during multi copying (continuous copying operation for providing a plurality of copies of the same original) and for clearing set number of copies to reset the standard mode "1"; a switch 103 for interrupting copy; ten keys 104 for setting the number of copies of the same image; an up switch 105 and a down switch 106 for setting copying magnification; a concentration down switch 107 and a concentration up switch 108 for designating developing toner concentration; a concentration auto adjustment switch 109; paper feeding portion selecting switch 111 for selecting either an upper paper feeding portion 50 or a lower paper feeding portion 52; LEDs 112 to 115 for indicating the size of papers of the selected paper feeding portion, and so on.

In the present embodiment, whether the toner is consumed rapidly or not is determined based on copying conditions defined by an operator by means of switches on the said operating panel 100. The copying conditions may be set by other means than the operation panel, for example by instructions from an original automatic feeding apparatus which feeds a placed original to the original glass support and automatically discharges the same after the copying operation.

The copying conditions under which the toner is rapidly consumed will be described in the following.

(1) Continuous copying

The amount of toner consumed for one copy from one original is constant However, in continuous copying operation, the amount of toner consumption per unit time will be large. In a common copying machine and the like, the time of driving of the developer (ON time of the said main motor M1) is longer than the time required for providing one copy, so that the developer is well mixed. Meanwhile, when the copying operation is carried out continuously, the driving time of the developer is approximately in correspondence with the time for the copying operation. Therefore, when one hundred copies are taken one by one, the developer is well mixed. On the contrary, when one hundred copies are taken continuously, the developer is not well mixed. Especially, when the copying operation is carried out under the condition of large toner consumption, the toner replenishment is carried out frequently, and how well the developer is mixed differs largely.

(2) When a large sized paper is used

As shown in Table 1, the amount of toner consumption increases as the size of paper is enlarged.

TABLE 1

Relation Between Paper Size and Toner Consumption

| Size | A5 | B5 | A4 | B4 | A3 |
|---|---|---|---|---|---|
| Toner Consumption | 18 | 27 | 36 | 54 | 72 |

*Toner Consumption [mg/one paper]
*Image Occupying Area 6%

(3) When copy density is set at "dark"

If the copying density is set at "dark", the toner consumption per one paper will be increased, even if the original is the same.

(4) When an enlargement copying is carried out

As shown in Table 1, the toner consumption is increased when an A4 sized original is enlarged to B4 or A3 size to be copied.

(5) Combination of the above described conditions

When continuous copying is carried out in "dark" mode on large sized copy papers, the toner is rapidly consumed and the toner replenishment is frequently carried out.

Figure 5:
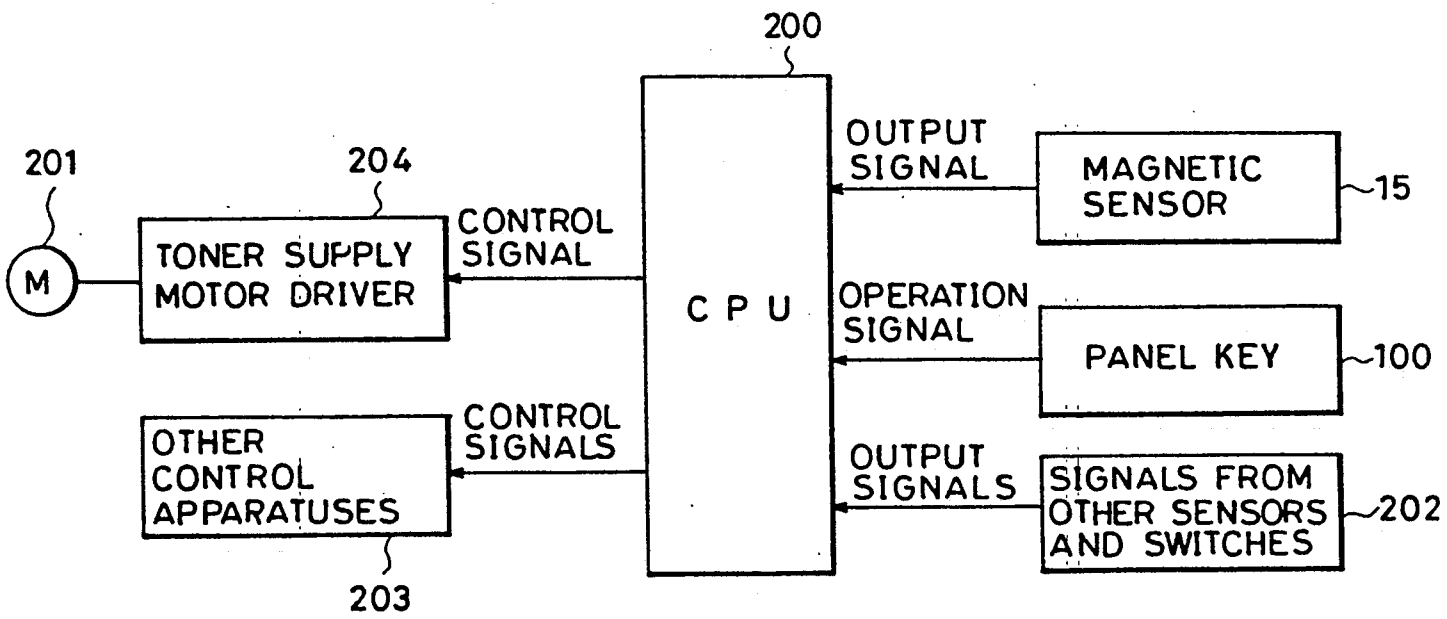
FIG. 5 is a schematic diagram of a control circuit in a copying machine in accordance with one embodiment of the present invention.

FIG. 5 is a schematic diagram showing a control circuit of the above described copying machine. As is shown in the figure, the control circuit mainly comprises a CPU 200 and various signals such as output signals from the above described magnetic sensor 15, key operation signals from the operation panel 100 and other signals from sensors and switches 202 provided at various portions of the copying machine are inputted to an input port of the CPU. Control signals for control apparatuses such as a driver 204 of the toner supplying motor and the like are outputted from an output port thereof.

Figure 6:
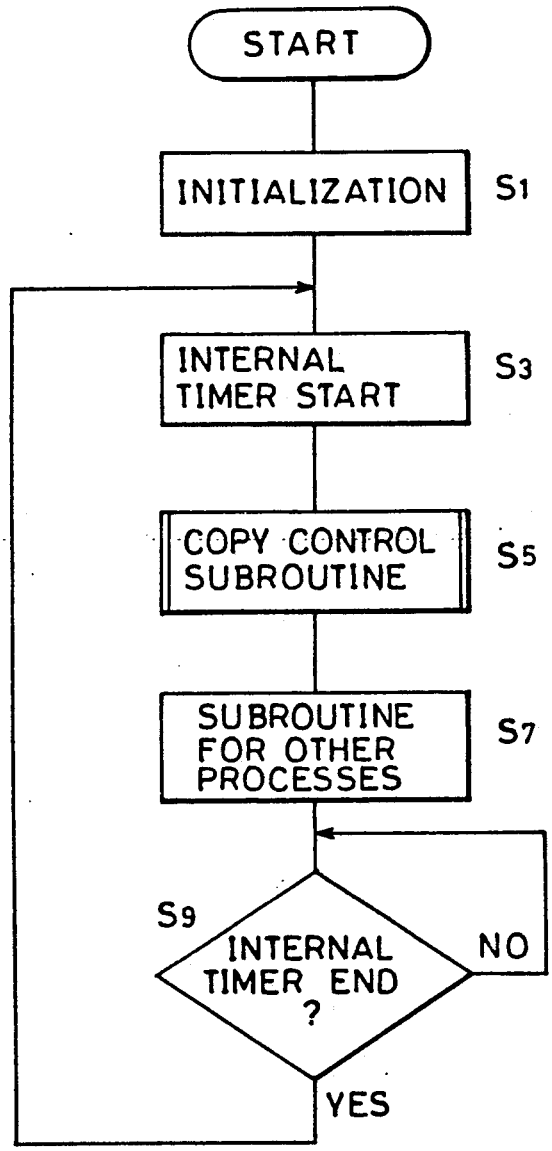
FIG. 6 is a control flow chart of a main routine in a CPU of the control circuit in accordance with one embodiment of the present invention.

FIG. 6 is a flow chart showing a main routine of the above described CPU 200. As is shown in the figure, various registers, copying mode and the like are initialized in turning on of the power (step S1). Thereafter, an internal timer is started (step S3) for making constant the length of one routine, a copy control subroutine (step S5) and other processing subroutine (step S7), which will be described later, are successively carried out, and the flow returns to the step S3 at the end of the internal timer (step S9).

Figure 7:
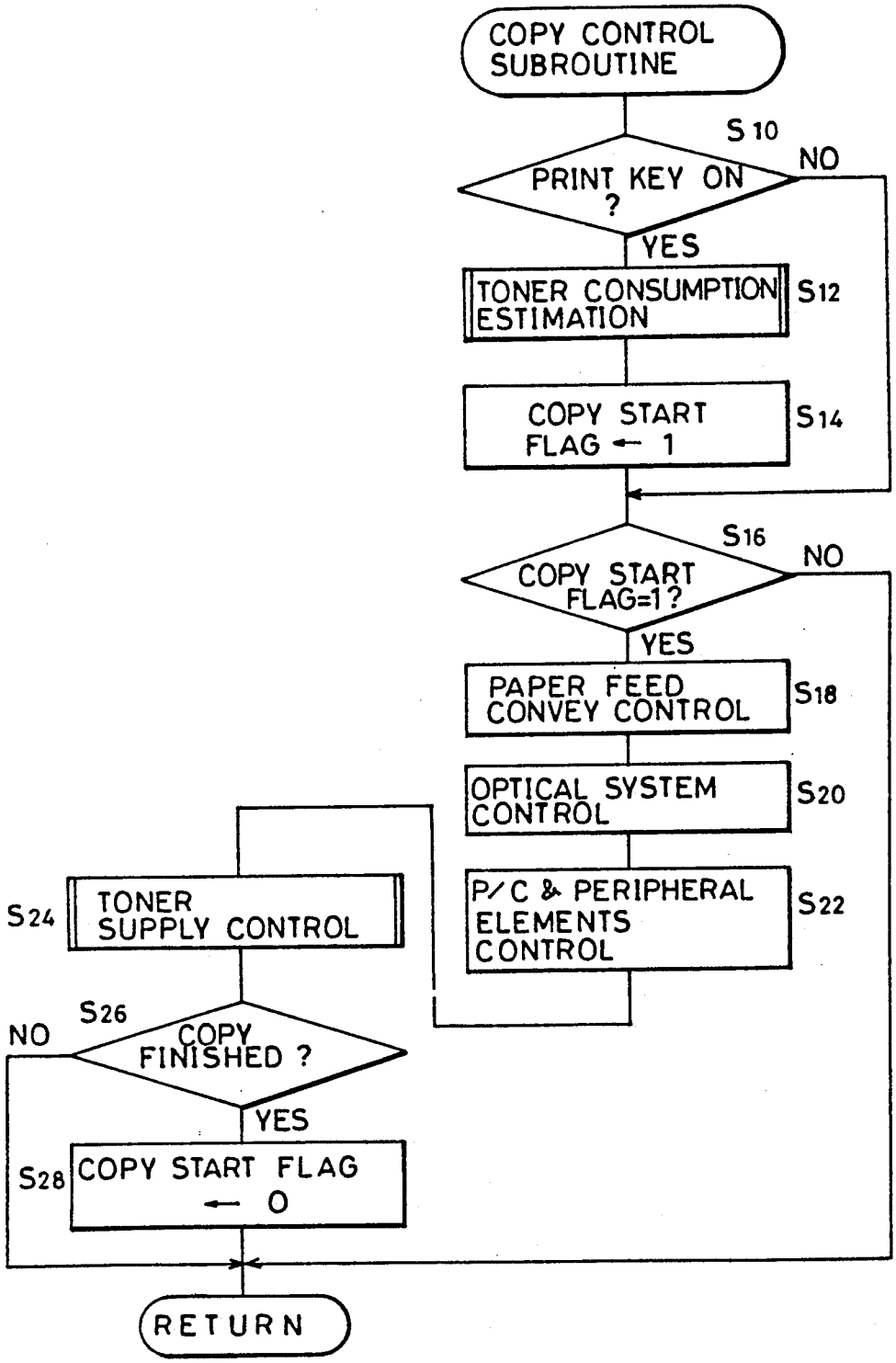
FIG. 7 is a flow chart showing definite contents of the copy control subroutine in FIG. 6.

FIG. 7 is a flow chart showing the details of the above described copy control subroutine. First, an ON edge of the print key 101 is checked, namely, whether there was a change from OFF state to ON state or not is determined (step S10). If the ON edge is detected, the toner consumption estimation, which will be described later, is carried out (step S12), and a copy start flag is set at "1" (step S14).

Thereafter, whether the copy start flag is "1" or not is checked in the step S16. If the flag is "1", paper feeding and conveying control (step S18), optical system control (Step S20), control of the photoreceptor drum and peripheral elements (step S22) and the toner supply control (step S24) are successively carried out, and when the copying operation for the set number of papers is completed, the copy start flag is set at "0" (step S28), and the flow returns to the main routine.

Figure 8:
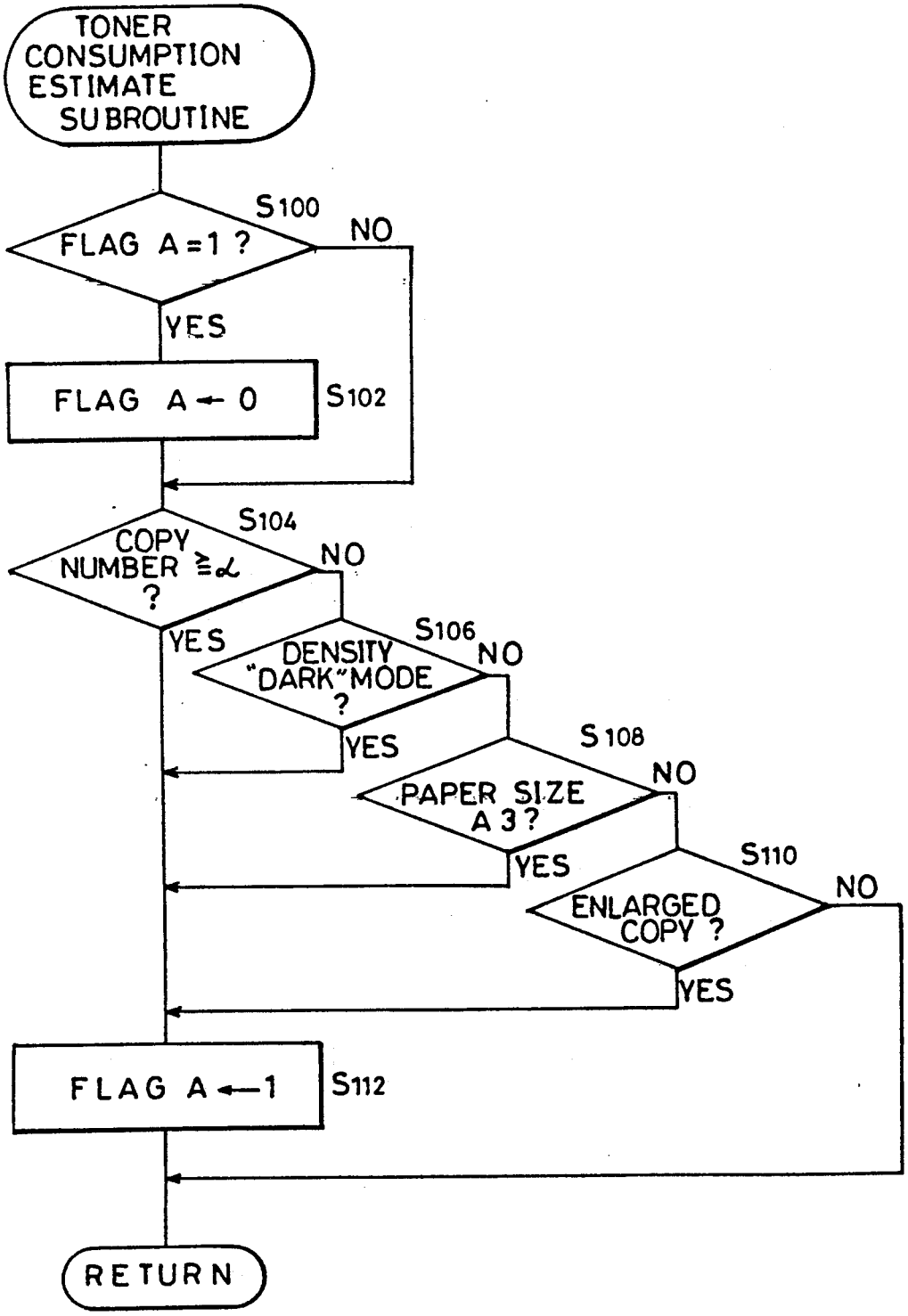
FIG. 8 is a flow chart showing definite contents of toner consumption estimating subroutine in FIG. 7.

FIG. 8 is a flow chart showing the details of the toner consumption estimate subroutine shown in FIG. 7. Now, the flag A is set at "1" when rapid toner consumption is expected. In the step S100, whether the flag A is "1" or not is checked. If the flag A is "1", the flag A is set at "0" (step S102). Meanwhile, if the flag A is "0", the flow skips to the step S104.

In the steps S104 to S110, when the number of multiple copying is no less than $\alpha$, when the copying density is set at "dark", when the copy paper (a copy paper to be fed) is A3, or when an enlargement copying is carried out, the flow proceeds to the step S112 to set the flag A at "1" and otherwise, the flow directly returns to the main flow. Now, "when the number of multiple copy is no less than $\alpha$" means that the initially set number for multiple copying is no less than $\alpha$.

Figure 9:
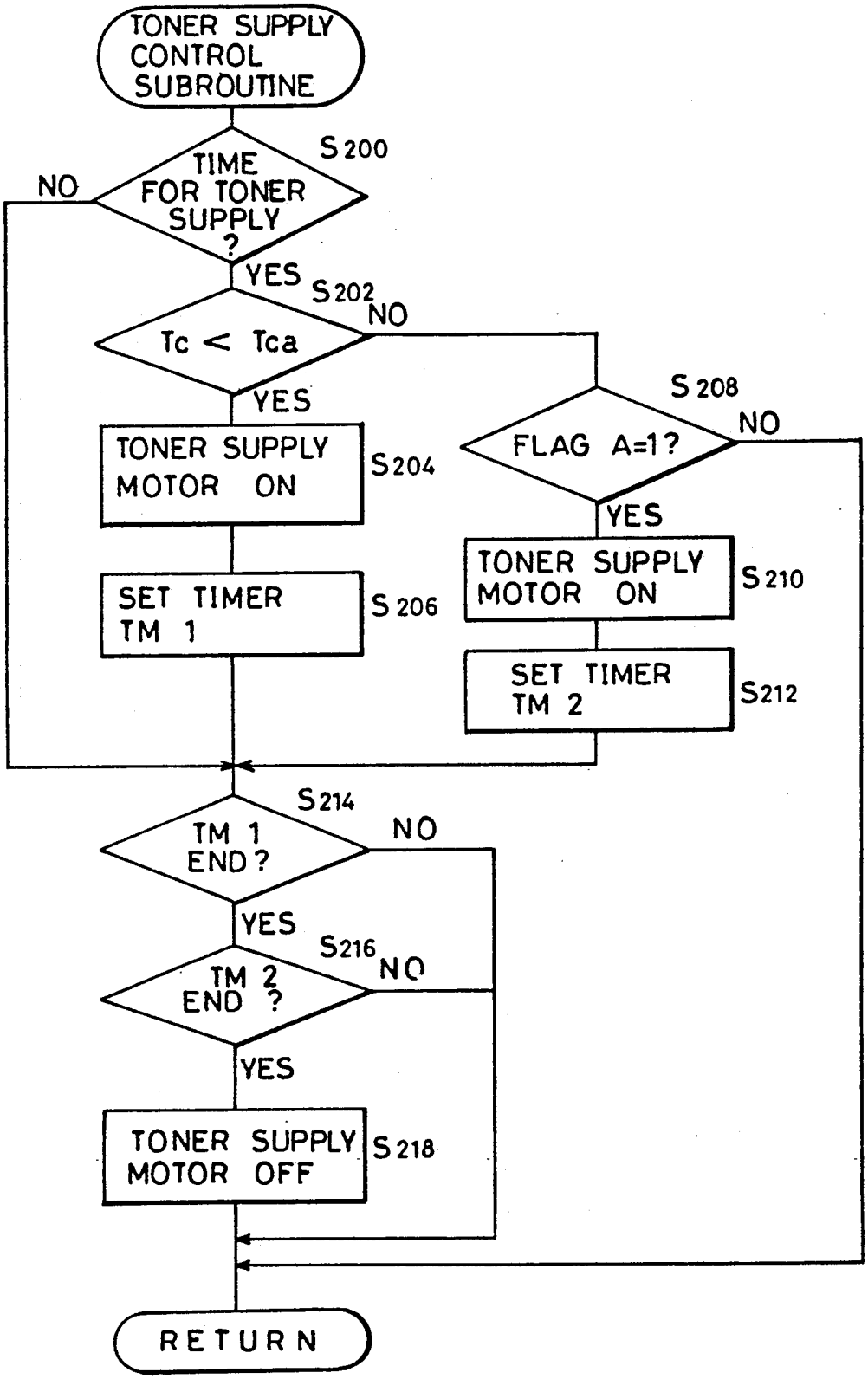
FIG. 9 is a flow chart showing definite contents of the toner supply control subroutine in FIG. 7.

FIG. 9 is a flow chart showing the toner supply control subroutine shown in FIG. 7. First, whether it is a time for supplying toner or not is checked (step S200). If it is the time for supplying toner (YES in S200), whether the toner concentration Tc is lower than a reference toner concentration Tca or not is determined (step S202). Now, in the present embodiment, the timing for toner supply is one time per one copy, which can be obtained from scanning signals of the optical system or from the signals from the paper feeding system.

When the toner concentration Tc is lower than the reference toner concentration Tca (YES in S202), the toner supply motor is turned on and a timer TM1 defining the ON time of the toner supply motor is set (step S206). The toner is supplied when the toner concentration becomes less than the reference value, in accordance with the timer TM1 (hereinafter referred to as real time toner supply).

When the toner concentration Tc is equal to or higher than the reference toner concentration Tca (NO in S202) whether the flag A is "1" or not is checked (S208) If the flag A is "1", the toner supply motor is turned on (S210) and a timer TM2 for defining the ON time is set (step S212). Toner is supplied in accordance with image forming conditions (hereinafter referred to as forecast toner supply) in accordance with the timer TM2. Now, the proportion of the time defined by the timer TM1 and the time defined by the timer TM2 is 10:1. The toner is supplied by 200 mg at one time with the timing defined by the timer TM1, while the toner is supplied by 20 mg at one time with the timing defined by the timer TM2. Now, in the present embodiment, the amount of the real time toner supply and the amount of the forecast toner supply are adjusted by controlling the ON time of the toner motor rotating at a constant speed. However, the number of rotation may be changed with the ON time of the toner motor being constant, or both the ON time and the number of rotation may be changed. The amount of forecast toner supply should preferably be small, since there will be continuous copying operation of an original having very small image area. The optimal amount may be determined in consideration of the amount of the real time toner supply, the amount of the developer, readiness to electrification of the toner, the faculty of mixing the developer of the developing apparatus, and so on.

Thereafter, when the operation of the timers TM1 and TM2 is ended, the toner supply motor is turned off (steps S214, 216 and 218). Meanwhile, when the operation of the timer TM1 is not ended or the operation of the timer TM2 is not ended, the flow skips the step S218 to return to the main routine.

Figure 10:
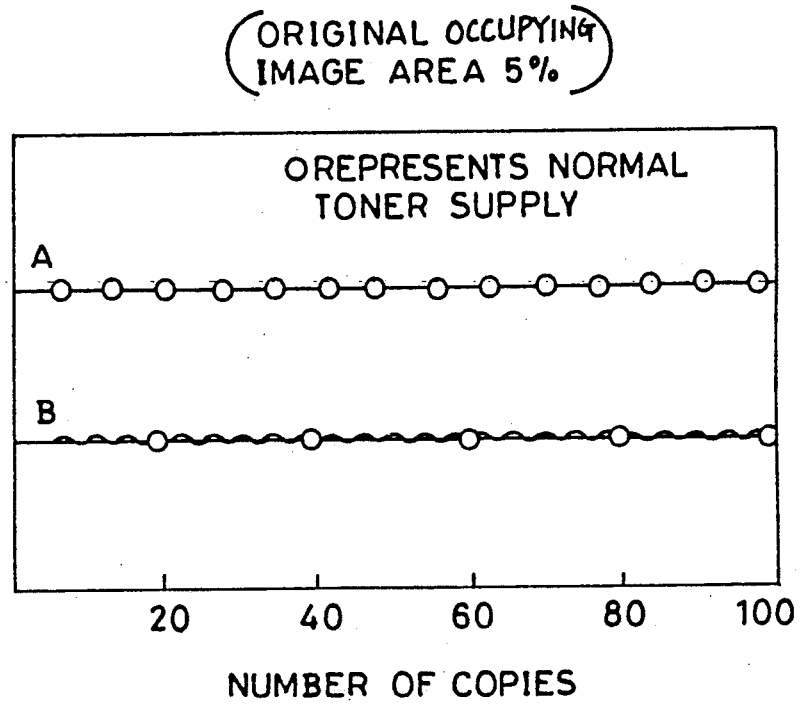
FIG. 10 is a graph showing numbers of real time toner supply comparing one embodiment of the present invention with the prior art.

FIG. 10 is a graph showing the number of real time toner supply, comparing one embodiment of the present invention with the prior art.

The abscissa represents the number of copies, the line A represents the prior art and the line B represents one embodiment of the present invention. The circle "o" represents normal supply, that is, real time toner supply. One example of toner supply for continuous copying operation is shown in the graph.

As is shown in the figure, compared with a case in which the forecast toner supply (constant supply) is not carried out (line "A"), the number of real time toner supply (normal supply) in which a large amount of toner is supplied at one time, is reduced in a case where the forecast toner supply is carried out (line "B" ). Consequently, problems caused by frequent real time toner supply in a short period of time, that is, insufficient electrification of toner due to insufficient mixing and the generation of fog or splash of toner, can be prevented.

In the above described embodiment, the amount of forecast toner supply is constant. However, the amount of the forecast toner supply may be changed dependent on the image forming conditions. Namely, in addition to the binary determination whether the toner is consumed rapidly or not, how rapid the toner is consumed is determined and the amount of the forecast toner supply may be changed in accordance with the image forming conditions.

As described above, according to the present invention, when the copying operation is carried out under such image forming conditions that the toner is rapidly consumed, a small amount of toner is continuously supplied, even if the toner concentration is more than the reference value. Therefore, the toner concentration hardly be less than the reference value, and the supply of a large amount of toner becomes less frequent. More specifically, in supplying a prescribed amount of toner, a large amount of toner is not intermittently supplied but a small amount of toner is continuously supplied, so that the toner is well mixed and well dispersed in the developer. Consequently, the toner is well electrified. Therefore, the toner neither appears as a fog on a paper nor splashes in the image forming apparatus.

Another embodiment of the present invention will be described in the following with reference to FIGS. 11 and 12. Since FIGS. 1 to 8 are common to the present embodiment, the description thereof will be omitted.

Figure 11:
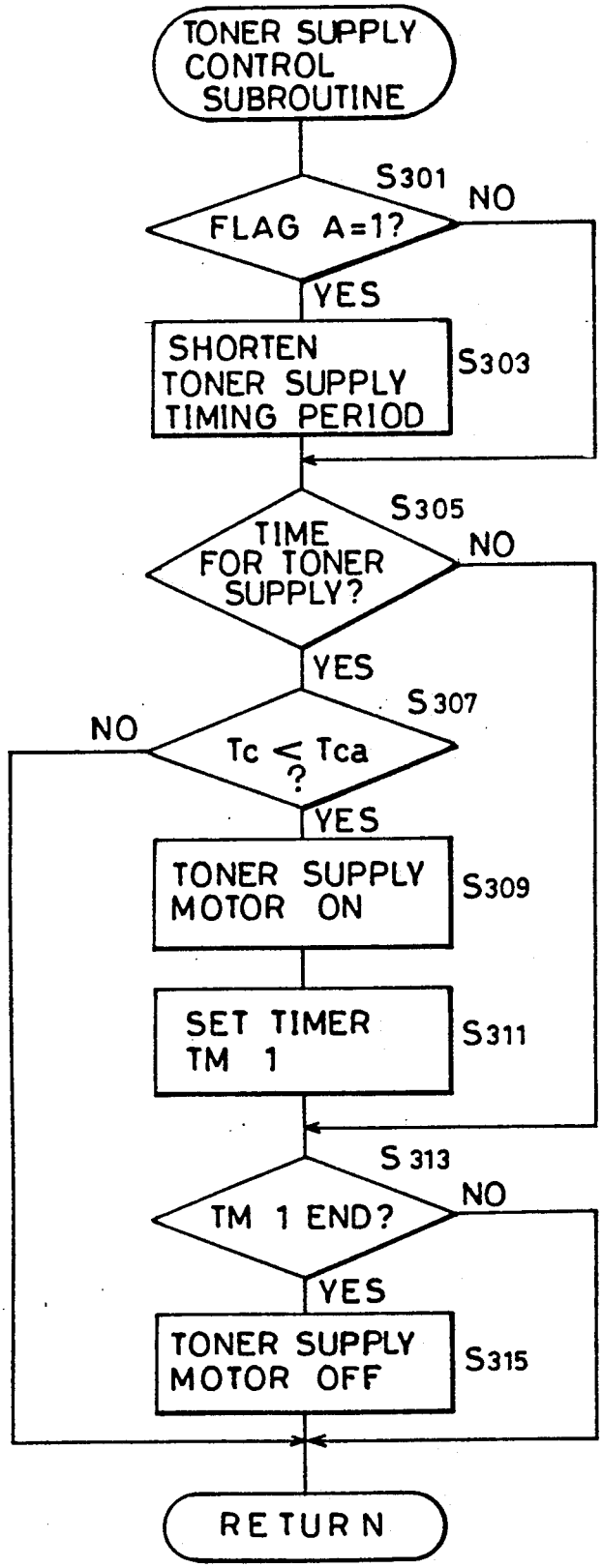
FIG. 11 is a flow chart showing definite contents of the toner supply control subroutine in accordance with another embodiment of the present invention.

FIG. 11 is a flow chart showing the toner supply control subroutine. First, whether the flag A is "1" or not is checked (step S301). If the flag A is "1", the toner supply timing period is reduced (step S303). In the present embodiment, the number of toner supply is increased from 1 to 2 in a unit copying time. Namely if the flag A is "1", the period will be one half compared with a case in which the flag A is "0". The period may be arbitrarily set in accordance with the structure of the developing apparatus, especially the structure of the developer conveying mechanism or the electrification characteristics of the developer employed, and so on.

Thereafter, whether it is time for toner supply or not is determined in the step S305, and if it is the time for toner supply, whether the toner concentration Tc is lower than the reference concentration Tca or not is checked. Meanwhile, if it is not the time for toner supply, the flow skips to the step S313. If the toner concentration is lower than the reference concentration, the toner supply motor is turned on, and the timer TM1 defining the ON state is set (steps S309 and S311). When the toner concentration is no less than the reference concentration, the flow directly returns to the main flow.

In the step S313, when the operation of the timer TM1 is ended, the toner supply motor is turned off (steps S313 and S315).

Figure 12:
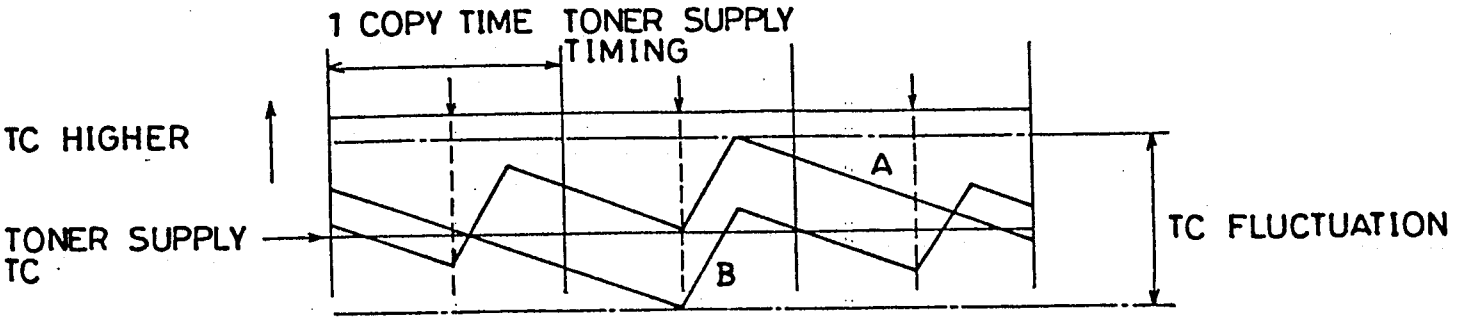
FIG. 12 is a graph showing a change of the toner concentration $T_C$ in the prior art when the toner is rapidly consumed.

FIG. 12 is a graph showing the change of the toner concentration Tc in the prior art when the toner supply timing is one per one unit copy time and the toner is rapidly consumed.

Figure 13:
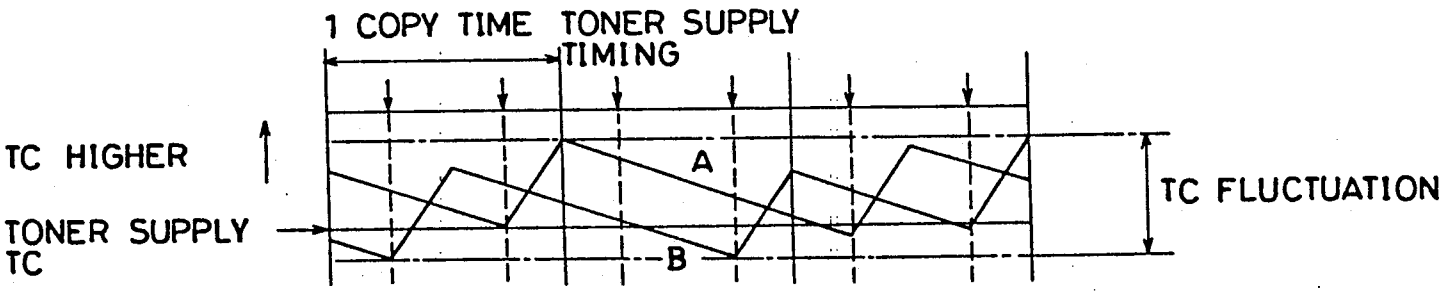
FIG. 13 is a graph showing the change of the toner concentration $T_C$ of another embodiment of the present invention when the toner is rapidly consumed.

FIG. 13 is a graph showing the change of the toner concentration Tc in the present embodiment when the toner supply timing is two per one unit copy time and the toner is rapidly consumed. Line A in each of the figures represents the highest TC after the toner supply, and the line B represents the lowest Tc before the toner supply. Therefore, the width between the highest Tc of the line A and the lowest Tc of the line B is the range of fluctuation of the toner concentration Tc. The speed of toner consumption is the same in FIGS. 12 and 13. As is apparent from FIGS. 12 and 13, the fluctuation of the toner concentration Tc becomes smaller when the period of the toner supply timing becomes shorter as in the case of the present embodiment, if the toner is rapidly consumed.

As described above, according to the present invention, the period of determining toner concentration, which is the base for determining whether a prescribed amount of toner should be supplied to the developing apparatus or not, is changed dependent on whether the toner is rapidly consumed or not.

More specifically, according to the present invention, the period of determining the necessity of toner supply is made shorter when the toner is rapidly consumed, while the period of determination is made longer in the normal condition.

Consequently, when the toner is rapidly consumed, the toner concentration is checked in a shorter period, and the toner is supplied. Therefore, the toner is supplied corresponding to the toner consumption with high responsiveness. Therefore, the width of fluctuation of the toner concentration in association with the reference value becomes smaller. In the normal conditions in which the toner is not so rapidly consumed, the toner concentration is checked in a longer period. Therefore, the toner concentration is detected after the toner is well mixed with the developer, thereby the toner supply can be carried out based on accurate toner concentration detection.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:
a photoreceptor on which a latent electrostatic image is formed;
latent electrostatic image forming means for forming a latent electrostatic image on said photoreceptor;
developing means for developing the latent electrostatic image on said photoreceptor by using a developer containing toner;
concentration detecting means for detecting toner concentration of said developer;
supplying means for supplying toner to said developing means;
first control means for activating said supplying means when said toner concentration detected by said concentration detecting means is lower than a prescribed concentration;
setting means for setting image forming condition; and
second control means for activating said supplying means when the image forming condition set by said setting means coincides with a prescribed condition irrespective of detection of toner concentration of the developer by the concentration detecting means.

2. An image forming apparatus comprising:
a photoreceptor on which a latent electrostatic image is formed;
latent electrostatic image forming means for forming a latent electrostatic image on said photoreceptor;
developing means for developing the latent electrostatic image on said photoreceptor by using a developer containing toner;
concentration detecting means for detecting toner concentration of said developer;
supplying means for supplying toner to said developing means;
first control means for activating said supplying means when said toner concentration detected by said concentration detecting means is lower than a prescribed concentration;
setting means for setting image forming condition; and
second control means for activating said supplying means when the image forming condition set by said setting means coincides with a prescribed condition, said second control means being activated on condition that the detected toner concentration is higher than said prescribed concentration.

3. An image forming apparatus according to claim 2, wherein said prescribed condition is that an amount of toner consumption per unit time is larger than the amount of toner consumption per unit time under a normal image forming condition.

4. An image forming apparatus according to claim 2, wherein said developer is a two-component developer containing carriers.

5. An image forming apparatus according to claim 2, wherein said concentration detecting means is activated at least one time in one image forming process.

6. An image forming apparatus comprising:
a photoreceptor on which a latent electrostatic image is formed;
latent electrostatic image forming means for forming a latent electrostatic image on said photoreceptor;
developing means for developing the latent electrostatic image on said photoreceptor by using a developer containing toner;
concentration detecting means for detecting toner concentration of said developer;
supplying means for supplying toner to said developing means;
first control means for activating said supplying means when said toner concentration detected by said concentration detecting means is lower than a prescribed concentration;
setting means for setting image forming condition; and
second control means for activating said supplying means when the image forming condition set by said setting means coincides with a prescribed condition, an amount of toner supplied by said supplying means activated by said second control means being smaller than the amount of toner supplied by said supplying means activated by said first control means.

7. An image forming apparatus according to claim 6, wherein said prescribed condition is that an amount of toner consumption per unit time is larger than the amount of toner consumption per unit time under a normal image forming condition.

8. An image forming apparatus according to claim 6, wherein said developer is a two-component developer containing carriers.

9. An image forming apparatus according to claim 6, wherein said concentration detecting means is activated at least once in one image forming process.

10. An image forming apparatus comprising:
a photoreceptor on which a latent electrostatic image is formed;
latent electrostatic image forming means for forming said latent electrostatic image on said photoreceptor;
developing means for developing the latent electrostatic image on said photoreceptor by using a developer containing toner;
concentration detecting means for detecting toner concentration of said developer;
determining means for determining in a prescribed period whether or not the detected toner concentration is no more than a prescribed concentration;
supplying means for supplying toner to said developing means in response to a determining output from said determining means indicating that the toner concentration is no more than a prescribed concentration;

setting means for setting an image forming condition; and control means for changing the prescribed period of said determining means during the copying operation when the image forming condition set by said setting means coincides with a prescribed condition.

11. An image forming apparatus comprising:

a photoreceptor on which a latent electrostatic image is formed;

latent electrostatic image forming means for forming a latent electrostatic image on said photoreceptor;

developing means for developing the latent electrostatic image on said photoreceptor by using a developer containing toner;

concentration detecting means for detecting toner concentration of said developer;

setting means for setting an image forming condition;

determining means for determining in a prescribed period whether or not the detected toner concentration is no more than a prescribed concentration, said determining means being activated at least one time in one image forming process when said image forming condition does not coincide with said prescribed condition, and being activated at least twice in one image forming process when said image forming condition coincides with said prescribed condition;

supplying means for supplying toner to said developing means in response to a determining output from said determining means indicating that the toner concentration is no more than a prescribed concentration; and control means for changing the prescribed period of said determining means when the image forming condition set by said setting means coincides with the prescribed condition, said prescribed condition being that an amount of toner consumption per unit time is larger than an amount of toner consumption per unit time under a normal image forming condition, and under which condition the prescribed period of said determining means is made shorter by said control means.

12. An image forming apparatus comprising:

a photoreceptor;

means for forming an electrostatic latent image on said photoreceptor;

means for developing the electrostatic latent image on said photoreceptor by using a developer containing toner;

means for detecting toner concentration of said developer;

means for supplying toner to said developing means;

first control means for activating said supplying means when said toner concentration detected buy said detecting means is lower than a prescribed concentration;

means for selecting a copying magnification; and second control means for activating said supplying means when a predetermined copying magnification is selected by said selecting means.

13. An image forming apparatus according to claim 12, wherein said second control means is activated on condition that the detected toner concentration is higher than said prescribed concentration.

14. An image forming apparatus according to claim 12, wherein an amount of toner supplied by said supplying means activated by said second control means is smaller than the amount of toner supplied by said supplying means activated by said first control means.

15. An image forming apparatus comprising:

a photoreceptor;

means for forming an electrostatic latent image on said photoreceptor;

means for developing the electrostatic latent image on said photoreceptor by using a developer containing toner;

means for detecting toner concentration of said developer;

means for determining in a prescribed period whether or not the detected toner concentration is no more than a prescribed concentration;

supplying means for supplying toner to said developing means in response to a determining output from said determining means indicating that the toner concentration is no more than a prescribed concentration;

means for selecting a copying magnification; and control means for changing the prescribed period of said determining means when a predetermined copying magnification is selected by said selecting means.

16. An image forming apparatus according to claim 15, wherein said predetermined copying magnification provides an enlarged copy such that an amount of toner consumption per unit time is larger than an amount of toner consumption per unit time under a normal image forming condition, and the prescribed period of said determining means is made shorter by said control means.

17. In an image forming apparatus comprising means for forming an electrostatic latent image on a photoreceptor, means for developing the electrostatic latent image by using a developer containing toner, means for detecting toner concentration of said developer, means for supplying toner to said developing means, and means for setting image forming condition, a method comprising the steps of:

setting image forming condition by means of said setting means before the start of the copying operation;

starting the image forming operation according to the image forming condition;

a first activating of the supplying means when said toner concentration detected by said detecting means is lower than a prescribed concentration; and a second activating of the supplying means when the image forming condition coincides with a prescribed condition.

18. A method as claimed in claim 17 wherein said prescribed condition is that an amount of toner consumption per unit time is larger than the amount of toner consumption per unit time under a normal image forming condition.

19. A method as claimed in claim 17 wherein said second activating is carried out on condition that the detected toner concentration is higher than said prescribed concentration.

20. A method as claimed in claim 17 wherein an amount of toner supplied by the supplying means upon the second activating is smaller than the amount of toner supplied by the supplying means upon the first activating.

21. In an image forming apparatus comprising means for forming an electrostatic latent image on a photoreceptor, means for developing the electrostatic latent image by using a developer containing toner, means for detecting toner concentration of said developer, means for supplying toner to said developing means, means for determining in a prescribed period whether or not the detected toner concentration is no more than a prescribed concentration, and means for setting image forming condition, a method comprising the steps of:

setting image forming condition by means of said setting means before the start of the copying operation;

starting the image forming operation according to the image forming condition; and changing the prescribed period for said determining when the image forming condition set by said setting means coincides with a prescribed condition.

22. A method as claimed in claim 21 wherein said prescribed condition is that an amount of toner consumption per unit time is larger than the amount of toner consumption per unit time under a normal image forming condition, and under which condition the prescribed period for determining is made shorter than the period for determining under a normal condition.

* * * * *

UNITED STATES PATENT AND TRADEMARK OFFICE

CERTIFICATE OF CORRECTION

PATENT NO. : 5,006,893

DATED : April 9, 1991

INVENTOR(S) : Tomoaki Yokoyama

It is certified that error appears in the above-identified patent and that said Letters Patent is hereby corrected as shown below:

In col. 4, line 2, change "provide" to --provided--.

In col. 6, line 57, change "On" to --Arrange on--.

In col. 7, line 21, after "constant", insert --.-- (period).

In col. 9, line 23, after "having", insert --a--.

In col. 10, line 1, after "concentration", insert --will--.

In col. 13, line 58 (claim 12, line 12), change "buy" to --by--.

Signed and Sealed this

Eighteenth Day of August, 1992

*Attest:*

DOUGLAS B. COMER

*Attesting Officer*

*Acting Commissioner of Patents and Trademarks*